US008247678B1

(12) United States Patent
Ivy

(10) Patent No.: US 8,247,678 B1
(45) Date of Patent: Aug. 21, 2012

(54) MEMBRANOPHONE TUNING SYSTEM HAVING POSITIONABLE MAGNETS

(75) Inventor: Steven Thomas Ivy, Irving, TX (US)

(73) Assignee: Steven T. Ivy, Ravenna, TX (US)

( * ) Notice: Subject to any disclaimer, the term of this patent is extended or adjusted under 35 U.S.C. 154(b) by 255 days.

(21) Appl. No.: 12/658,216

(22) Filed: Feb. 4, 2010

Related U.S. Application Data

(60) Provisional application No. 61/177,765, filed on May 13, 2009.

(51) Int. Cl.
*G10D 3/02* (2006.01)
*G10G 7/02* (2006.01)

(52) U.S. Cl. ..... 84/726; 84/291; 84/296; 84/312 R; 84/411 A; 84/411 M; 84/453; 84/454

(58) Field of Classification Search ..... 84/726
See application file for complete search history.

(56) References Cited

U.S. PATENT DOCUMENTS 5,561,254 A * 10/1996 Huffer ..... 84/411 M
5,877,440 A * 3/1999 Chaffee et al. ..... 84/411 M
6,420,008 B1 * 7/2002 Lewis et al. ..... 428/78
7,678,979 B1 * 3/2010 Roop ..... 84/309
7,687,695 B2 * 3/2010 DeJule ..... 84/270
2008/0104868 A1 * 5/2008 Drie ..... 40/110

* cited by examiner

*Primary Examiner* — Elvin G Enad
*Assistant Examiner* — Christopher Uhlir
(74) *Attorney, Agent, or Firm* — Jeffrey Roddy

(57) ABSTRACT

A system for changing the acoustical characteristics of a musical membranophone having a vibrating membrane or a stringed musical instrument having a sound box includes an overlay including indicia dividing a surface of the vibrating membrane or sound box into discrete zones enabling a user to position magnetic members to obtain predictable effects based on experimentation or a guide such as a diagram illustrating the position of magnetic members on the overlay, a first rare earth magnetic member is adapted to be disposed on a first side of the membrane or sound box, a second rare earth magnetic member is disposed on an opposed side of the membrane or sound box such that the first and second magnetic members are magnetically engaged on opposed sides of the membrane or sound box wherein the mass of the first and second magnetic member is sufficient to change the acoustical characteristics of the instrument.

5 Claims, 4 Drawing Sheets

MEMBRANOPHONE TUNING SYSTEM HAVING POSITIONABLE MAGNETS

CROSS REFERENCE TO RELATED APPLICATIONS

This application claims the benefit of Provisional Patent Application No. 61/177,765 filed May 13, 2009

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

FIELD OF INVENTION

The invention relates to an apparatus and method for altering and tuning the sounds produced by a musical membranophone or sound box, and in particular to the use of magnets to change the acoustical characteristics by weighting and compressing the vibratable surface of the membranophone or sound box in specific locations.

BACKGROUND

In many instances, it may be desirable to change the acoustical characteristics of a musical instrument such as a drum, guitar, banjo or other instrument employing a musical membranophone or resonating sound box in order to achieve certain desired effects. In some cases, it is also desirable to dampen unwanted feedback and resonance in order to improve the quality of sound produced by such instrument. However, changing the acoustical characteristics of such musical instruments is generally not feasible due to the way the instruments are constructed and configured. Thus, there exists a need for a simple and repeatable method, apparatus and system for changing the acoustical characteristics of a musical instrument such as a drum, guitar, banjo or other instrument employing a musical membranophone or sound box.

SUMMARY

In one aspect, an apparatus for changing the acoustical characteristics of a musical instrument such as a musical membranophone having a vibrating surface, includes a first rare earth magnet disposed on a top side of the surface. A second rare earth magnet is disposed on an opposite side of the surface at the same relative location as the first magnet such that the first and second magnets are magnetically engaged on opposed sides of the surface. The first and second magnets have sufficient mass to change the acoustical characteristics of the instrument when the surface is caused to vibrate.

In another aspect, an apparatus for the acoustical characteristics of a stringed musical instrument having a sound box includes a first rare earth magnet disposed on a first side of the sound box, typically a sound board. A second rare earth magnet is disposed on an opposed side of the sound board at the same relative location as the first magnet such that the first and second magnets are magnetically engaged on opposed sides of the sound board. The first and second magnets are selected to have sufficient mass to change the acoustical characteristics of the instrument when the sound box is caused to vibrate.

In yet another aspect, a system for changing the acoustical characteristics of a musical membranophone having a vibratable membrane, a stringed musical instrument having a sound box with tensioned membrane or stringed instrument with a sound board and a sound box which also includes an overlay with indicia dividing a surface of the vibrating membrane or sound box into discrete zones or coordinates enabling a user to position magnetic members to obtain predictable effects based on experimentation or with the use of a guide such as a diagram illustrating the position of magnetic members on the overlay. A first rare earth magnetic member is adapted to be disposed on a first side of the membrane or sound board. A second rare earth magnetic member is adapted to be disposed on an opposed side of the membrane or sound board at the same relative location as the first magnetic member such that the first and second magnetic members are magnetically engaged on opposed sides of the membrane or sound box. In this regard, the first and second magnetic members have sufficient mass to change the acoustical characteristics of the instrument when the membrane or sound box is caused to vibrate.

BRIEF DESCRIPTION OF THE DRAWINGS

For a more complete understanding, reference is now made to the following description taken in conjunction with the accompanying Drawings in which.

DETAILED DESCRIPTION

Reference Numbers and Corresponding Elements Listing

Figure 1:
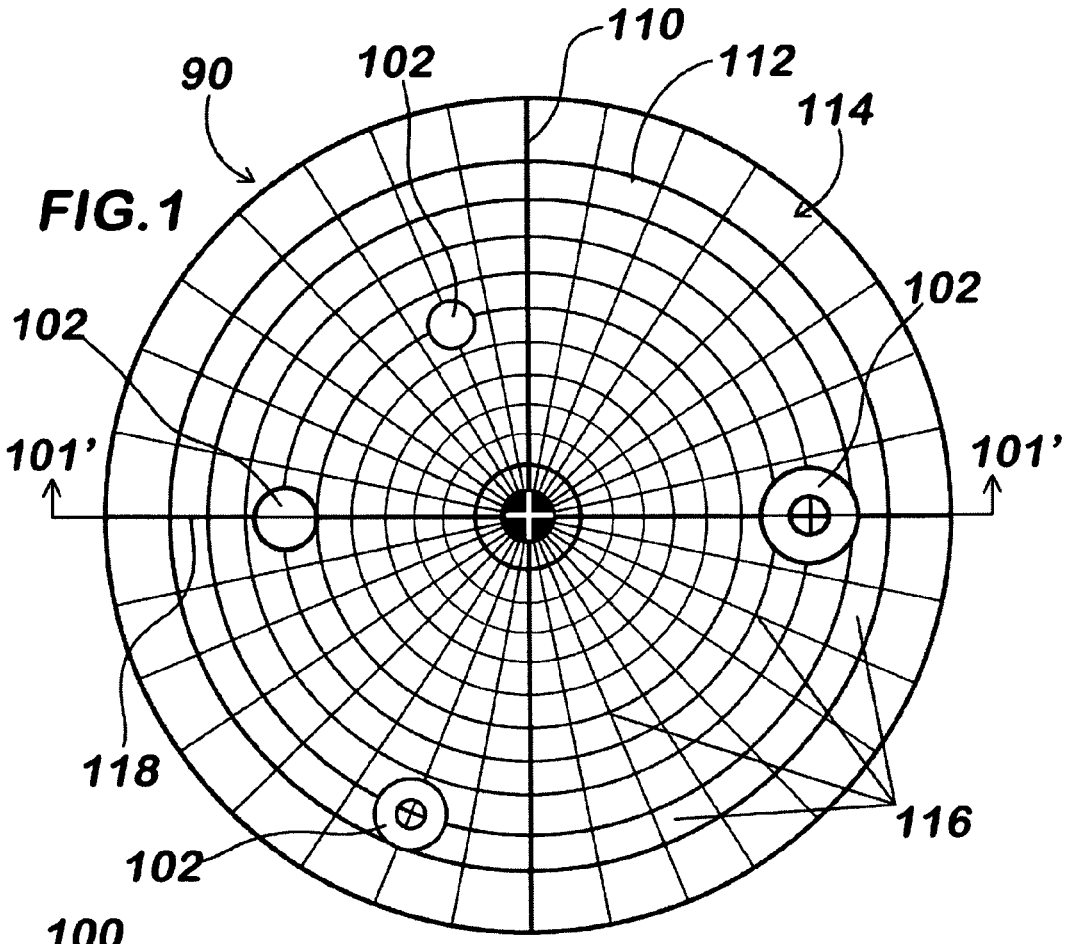
FIG. 1 is a top plan view of the vibratable surface 90 of a membranophone employing the present invention; and, FIG. 2 is a cross sectional view of FIG. 1 taken along lines 101'-101' of a membranophone employing the present invention; and, FIG. 3 is a perspective view of an embodiment according to the present invention being utilized to alter the sound of a banjo head; and, FIG. 4 is a perspective view of an embodiment according to the present invention being utilized to alter the sound of a mandolin; and, FIG. 5 is a perspective view of an embodiment according to the present invention employing the present invention with a variety of magnet types; and, FIG. 6 depicts a exemplary grouping of magnet shapes that are used according to the present invention; and, FIGS. 6*a* and 6*b* are side and top views of an embodiment according to the present invention depicting a violin bow being drawn across an arm 134, the arm connected to the face of a magnetic member placed atop a membrane.

90 Vibrating surface
100 Membrane
102 Magnetic member
104 Drumhead
108 Grid
110 Radial lines

112 Concentric/Circumferential lines
114 Grid overlay
116 Grid zone
118 Zero angle reference line
120 Sound board
122 Transducer/Pick up
124 Amplifier
126 Mandolin
128 Spring/Coil connector
130 Wire connector
134 arm
136 bow
200 Stringed Membranophone
300 Sound board Referring now to the drawings, wherein like reference numbers are used herein to designate like elements throughout, the various views and embodiments of a drum tuning system are illustrated and described, and other possible embodiments are described. The figures are not necessarily drawn to scale, and in some instances the drawings have been exaggerated and/or simplified in places for illustrative purposes only. One of ordinary skill in the art will appreciate many possible applications and variations based on the following examples of possible embodiments.

Referring generally to FIGS. 1-7, the present invention is a system for altering the vibrational characteristics of a membranophone. One or more magnetic pairs are used to alter the vibrational characteristics of the vibrating surface 90 of a membranophone. Magnetic members 102 are selected to have a sufficiently strong magnetic field so that magnetic members 102 will attract each other to hold the magnetic pair firmly in place against a vibrating surface 90 without the use of additional fixtures or devices. Utilizing powerful rare earth magnetic members in this manner allows changes in the acoustical characteristics of a musical instrument by simply sliding the magnetic members from one location to another over the vibrating surface 90 into any desired position without removing the magnetic members from the vibrating surface 90. Magnetic members 102 do not require grommets or other fixed location mounting fixtures in or on vibrating surface 90. Magnetic members 102 are also selected to have sufficient mass to change the acoustical characteristics of the instrument when the magnetic members are coupled or engaged on opposite sides of vibrating surface 90.

Figure 2:
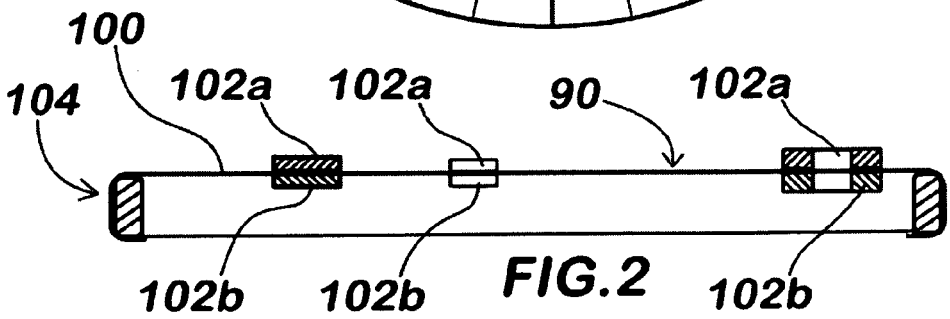

One embodiment according to the present invention depicted in FIG. 1 and FIG. 2, includes at least one pair 102*a*, 102*b* of powerful disk-shaped rare earth type magnets 102 (e.g. Neodymium-iron-Boron or similar) positioned on opposite surfaces of a vibrating surface 90 exemplified in this case by a tensioned membrane 100 of a drumhead. The magnetic members are positioned opposite one another in the same relative location and generally coaxially in the case of circular magnetic members 102 such that the magnetic members are magnetically engaged or coupled with the membrane 100 which is sandwiched between the magnetic members. FIG. 2 shows several pairings, each including a first magnetic member 102*a* placed on the top of membrane 100 and a second magnetic member 102*b* placed on the bottom of the membrane relatively opposite the first.

As magnetic members 102 are moved to different positions on vibrating surface 90 each new position will result in a new and different sound as membrane 100 vibrates. Typically, magnetic members 102 will have a disk-like circular geometry. If disk-shaped magnetic members 102 used in a magnetically coupled pair on opposed sides of membrane 100 have different diameters, the extended lip or portion of the larger diameter magnetic member that extends past the perimeter of the small diameter magnetic member will cause a potentially pleasant rattling sound as the membrane slaps against the unbounded edge of the larger diameter magnetic member.

Referring again to FIG. 1 and FIG. 2, in the case of a percussive membranophone, when a drum head or the attached magnetic member is struck the mass of attached magnetic members 102 will alter the normal sound of the drum. In one embodiment, a plurality of same mass or different mass magnetic member pairs may be used. The mass of magnetic members 102 on membrane 100 can change the pitch, the timbre, as well as the sound amplitude envelope and the effects may be easily altered by merely sliding the magnetic members across the membrane. As magnetic members 102 are repositioned on membrane 100, each new position of the magnetic members can create different, interesting and/or unusual sound effects. The greater the number of magnetic members 100 used the more complex the resulting tone possibilities are. These variations are unlimited and rely on the skill of the instrument tuner and/or the drum player. In one aspect, drumhead 104 includes a grid 108 including respectively, radial 110 and circumferential lines 112 that divide the drum head into a plurality of discrete zones 116. The zones 116 can either be at the nexus of the radial and circumferential lines or the demarcated areas between the indicia. A player may place magnetic members 100 on or within different zones 116 to experiment, generate different sounds and effects and then transcribe the locations or zones where the magnetic members are positioned. The notations corresponding to the zones may be written or printed on sheet music to correlate with and compliment standard music notation. In this manner the player may experiment, come up with pleasing sounds or effects, and note the mass and location of the magnetic members used and the positions of the magnetic members using radial and circumferential coordinates based on lines 110 and 112. For example, the following coordinates (10, 2, +45) would represent a 10 gram magnetic member set positioned on the 2 cm from the center ring and on the +45 degrees from zero angle reference line 118. In other variations, the user may obtain predictable and repeatable sound effects with the use of a guide such as a diagram illustrating the position and/or mass of magnetic members on the overlay corresponding to the desired effects.

FIG. 2 is a cross sectional view of a drumhead 104 wherein a plurality of magnetic member pairs has been positioned on the membrane of a drumhead. In other embodiments zones 116 may be numbered or otherwise labeled to compliment the foregoing coordinate system to enable a player to place magnetic members to select particular sound effects.

Figure 3:
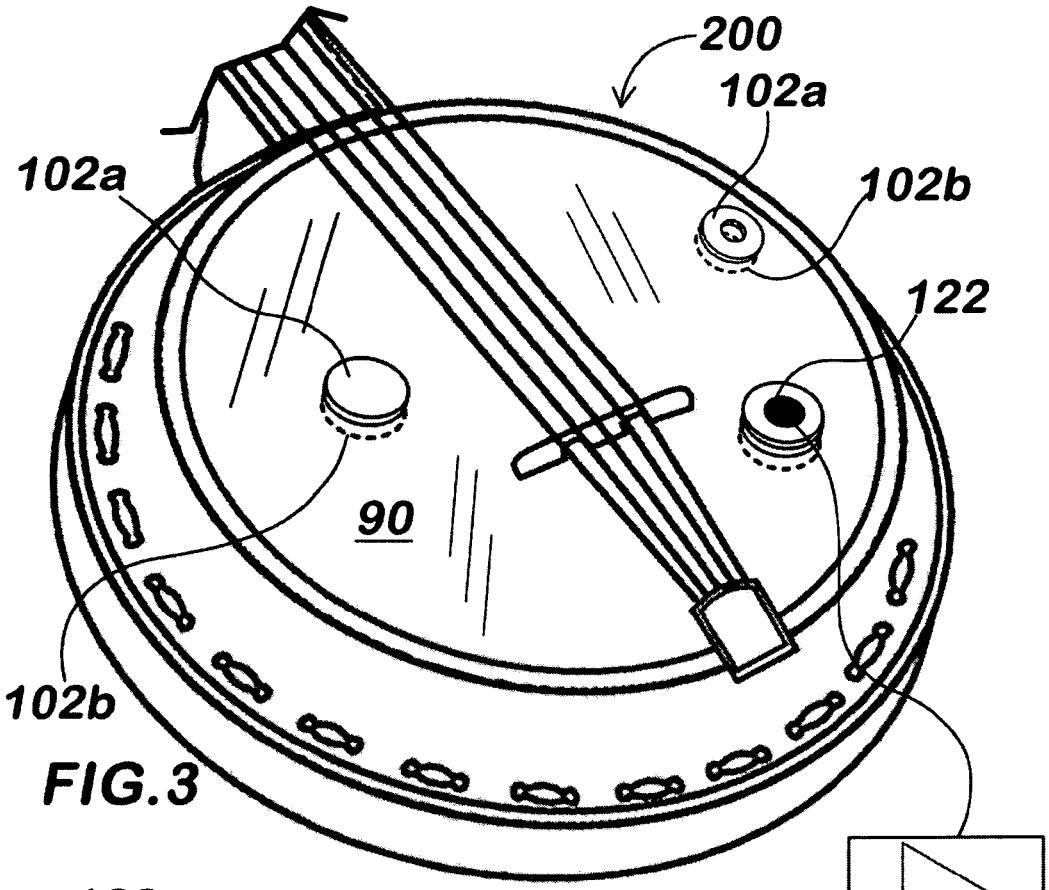
Figure 4:
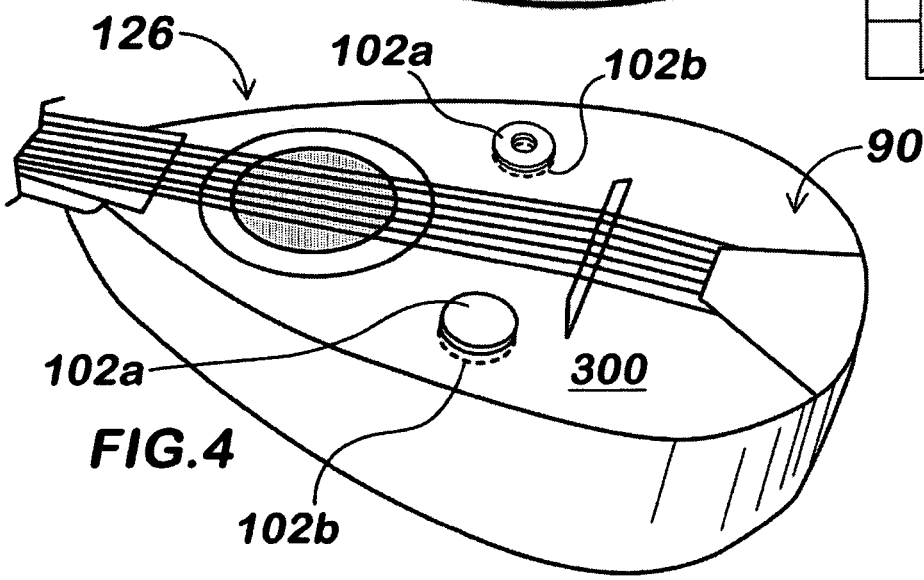

While in FIGS. 1-2, grid 108 is illustrated and described in connection with a drum head, the grid may be used with other musical instruments such as banjos, guitars and other instruments employing a vibrating surface 90 to generate sounds. If the membranophone is a stringed type instrument (a banjo for instance) as depicted in FIG. 3, the vibrations of the strings will combine with the unusual resonance effects due to the presence of the magnetic members which allows the instrument to generate many new and interesting sound effects. In FIG. 4 an embodiment according to the present invention is used to alter the resonant characteristics of a sound board 300 of a mandolin 126.

In other embodiments, the membrane may be configured with differently colored zones or a different type of grid in order to allow a player to identify and reuse a particular magnetic member configuration. In one variation, a system for changing the acoustical characteristics or an instrument may include a printed overlay 114 of thin plastic or paper incorporating a grid for placement atop a vibrating surface 90 of a musical membranophone and an assortment of magnetic member pairs having the same or differing masses. The use of grid 108 enables a player to repeat different effects, since the position of the magnetic members may be recorded and the magnetic members repositioned at desired locations to generate the desired effects. The use of the grid 108 would be especially useful for musicians collaborating in separate locations where a need exists to match for example, the acoustic characteristics of a second drum to the acoustical characteristics of a first drum.

Referring again to FIG. 3, an electromechanical pickup or transducer 122 may be connected to one of magnetic members 102 to allow the sound of the membranophone to be run into an amplifier 124 (with or without electronic effects). In addition to transmitting signals from transducer 122 it is possible to transmit signals from amplifier 124 to transducer 122 which may produce different sounds. For example, signals from the amplifier may cause a drum or banjo type instrument to generate different sounds, including sounds not normally associated with such instruments.

Turning to FIG. 4, in another variation, magnetic members 100 may be used to adjust the tone of a stringed instrument exemplified herein as a mandolin 126. One magnetic member 102*a* may be placed on an the soundboard 300 of the instrument and the corresponding magnetic member 102*b* placed opposite the first magnetic member within the sound box such that magnetic members are magnetically coupled to retain the magnetic members on the instrument body. The added mass of magnetic members may change the acoustical characteristics of the stringed instrument in that the added mass may alter the natural resonance, or damp out undesired feedback resonance during live play. This is in contrast to other techniques for damping undesired resonance such as placing rags in the sound box with results in an undesired dull damping effect. Further, the use of magnetic members provide for quick adjustments of tone and resonance by players and sound engineers. Further still, the use of magnetic members has the potential to improve the sound of inexpensive stringed instruments by improving the tone and resonance effects of the instrument. Likewise magnetic member pairs may be used on cymbals to create interesting sound effects.

Figure 5:
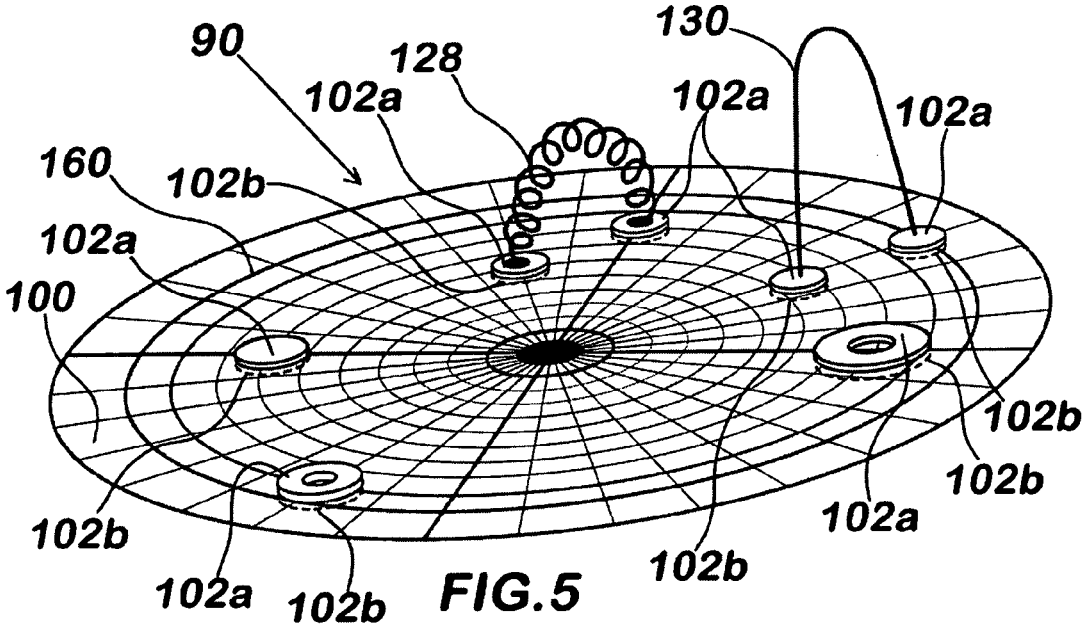

In yet another embodiment as depicted in FIG. 5 in which the vibrating surface 90 is the percussive membrane of a drum, a connecting member depicted as a spring 128 or a wire 130 may be used to-connect two or more magnetic members 102 on one side of a membrane of the membranophone. With respect to the spring 128, vibration of membrane 100 will cause the spring to vibrate and create interesting echo and reverberation effects. Spring 128 may be formed from suitable steel or a phosphor bronze alloy. In one variation, spring 128 may be formed from a non-magnetic material such as stainless steel, a suitable plastic material or phosphor bronze such that the spring is not attracted to an adjacent magnetic member. Although as illustrated, two magnetic members 102 are connected with spring 128, in other embodiments, more than two magnetic members 102 may be interconnected with one or more springs 128. While in the foregoing illustration a coil spring loosely connects magnetic members, it will be appreciated by those skilled in the art having benefit of this disclosure that various types of connecting members such as a flat spring, wire, cable and others may be used depending on the desired acoustic effects.

Figure 6:
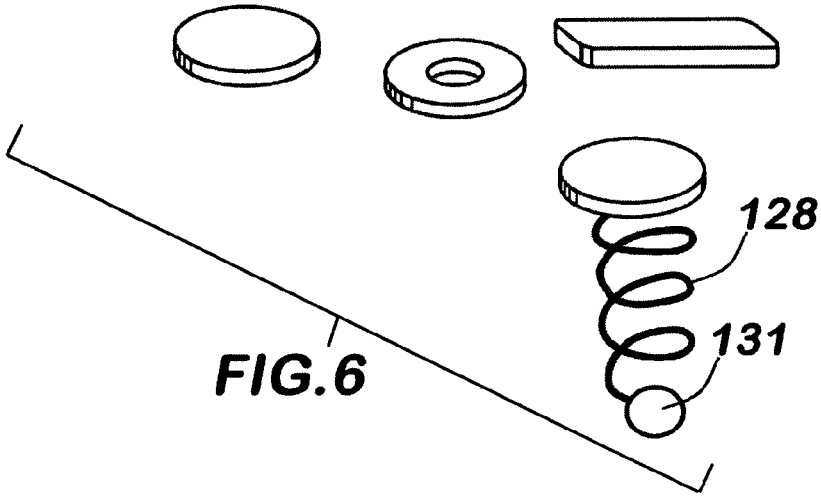

FIG. 6 depicts an exemplary grouping of various magnetic members that are employable according to the present invention. It will be appreciated by those having skill in the art that the examples given are not exhaustive as magnetic members are produced in many shapes and sizes and conceivably ovoid or spherical magnetic members may be employed to produce desirable results. The selection of magnetic members is entirely dependent on the desired sound. One variation of a magnetic member is shown with a weighted dampener 131 affixed to the terminus of a hanging spring which is itself affixed to the bottom of a magnet 102*b*.

Figure 6A:
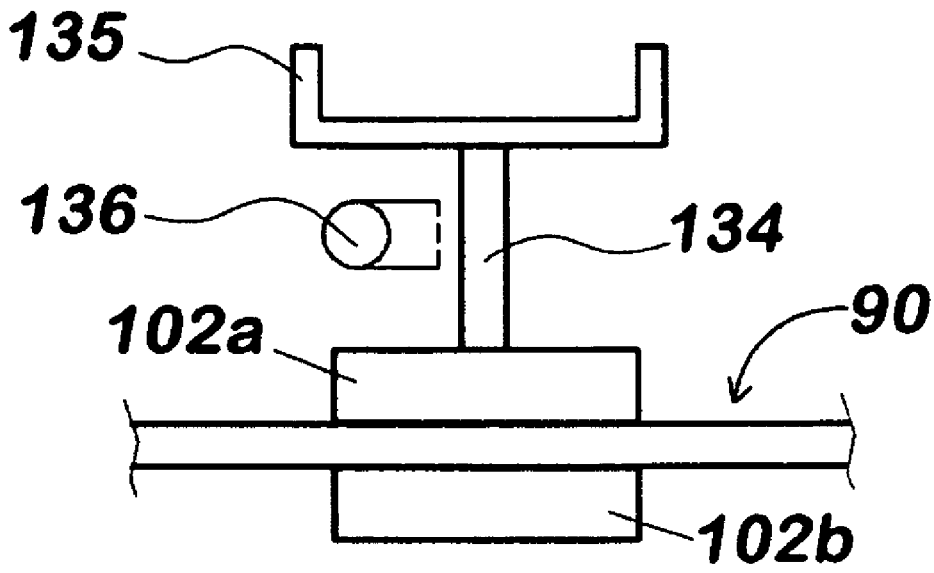
Figure 6B:
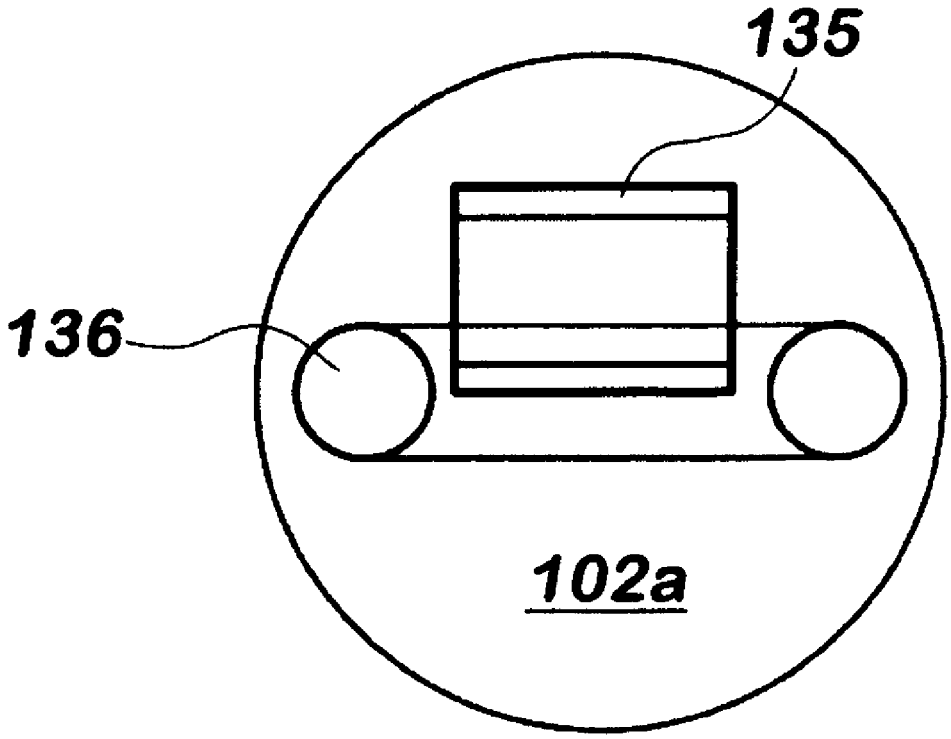

FIGS. 6*a* and 6*b* represent a bowed instrument employing magnetic members 102 positioned on opposed sides of vibrating surface 90 of a membranophone including a first magnetic member 102*a* atop the vibrating surface and a second magnetic member 102*b* on the underside of the vibrating surface 90. The use of a bow 136 will provide interesting sustained sounds as it is drawn across the magnetic members or other accessories attached to the membrane. To better facilitate bowing, arm 134 comprises a special magnetic alloy based attachment having an elevated T-shape, with upraised ends 135 on the T to facilitate bowing and to keep the bow from falling off the end of arm 134 as it is drawn across the T. This allows bow 136 to run across and vibrate the T-shaped arm 134 and thus have the vibrations transferred to the vibrating surface 90. The sound thus produced can be altered by touching or tapping the vibrating surface 90 or the attached magnetic member.

It will be appreciated by those skilled in the art having the benefit of this disclosure that this drum tuning system provides an apparatus and method for altering and/or tuning the sounds produced by a musical membranophone whether stringed on not. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An apparatus for changing acoustical characteristics of a musical instrument comprising:

a membranophone having a vibratable surface having a top side and an underside; and, a grid overlay including indicia for reproducing positions of magnetic members placed on the surface; and, at least one pair of magnetic members including a first rare earth magnetic member disposed on the top side, and a second rare earth magnetic member disposed on the underside at a same relative location as the first magnetic member such that the first and the second magnetic members are magnetically engaged on the opposite top and underside of the vibratable surface; and, in which the first and second magnetic members have sufficient mass to change the acoustical characteristics of the instrument when the instrument is played.

2. An apparatus for altering acoustical characteristics of a musical instrument having a sound box, the apparatus comprising:

a membranophone having a vibratable surface with a top side and an underside, and, at least one pair of magnetic members including a first rare earth magnetic member disposed on the top side, and a second rare earth magnetic member disposed on the underside of the vibratable surface at a same relative location as the first magnetic member such that the first and second magnetic members are magnetically engaged on opposed sides of the vibratable surface; and in which the first and second magnetic members have sufficient mass to change the acoustical characteristics of the instrument when the vibratable surface is caused to vibrate; and, indicia including a grid pattern placed on the top side in which the location of magnetic members placed on the vibratable surface is reproducible by a coordinate system in which at least one value represents a mass of at least one magnetic member.

3. A system for changing accoustical characteristics of musical membranophones having a vibratable surface, the system comprising:

the vibratable surface having a top side and an underside, and, an overlay including indicia dividing a vibrating surface into discrete zones, and, at least one pair of magnetic members including a first rare earth magnetic member disposed on the top side, and a second rare earth magnetic member disposed on the underside of the vibratable surface at a same relative location as the first magnetic member such that the first and second magnetic members are magnetically engaged on opposed sides of the vibratable surface; and, in which the first and second magnetic members have sufficient mass to change the acoustical characteristics of the instrument when the vibratable surface is caused to vibrate.

4. The system according to claim 3 in which the musical membranophone is a stringed instrument.

5. A system for replicating a sound of a first musical membranophone to a second musical membranophone comprising:

a musical instrument with a vibratable surface, the vibratable surface having a top side and an underside, and, indicia including a grid pattern placed on the top side, and at least one magnetic member placed atop the indicia and a corresponding magnetic member placed on the underside of the vibratable surface, the two magnetic members magnetically coupled, and, locations on the grid pattern corresponding to and reproducible by a coordinate system, and, at least one value representing a mass of the at least one magnetic member; and, recording coordinates in the form of notations for subsequent reproduction of a particular sound.

* * * * *